US010655424B2

(12) United States Patent
White

(10) Patent No.: US 10,655,424 B2
(45) Date of Patent: May 19, 2020

(54) BUCKLE PREVENTION RING

(71) Applicant: Max White, Arlington, TX (US)

(72) Inventor: Max White, Arlington, TX (US)

( * ) Notice: Subject to any disclaimer, the term of this patent is extended or adjusted under 35 U.S.C. 154(b) by 209 days.

(21) Appl. No.: 15/193,705

(22) Filed: Jun. 27, 2016

(65) Prior Publication Data

US 2017/0002621 A1 Jan. 5, 2017

Related U.S. Application Data

(60) Provisional application No. 62/187,558, filed on Jul. 1, 2015.

(51) Int. Cl.
*E21B 33/128* (2006.01)
*E21B 33/12* (2006.01)

(52) U.S. Cl.
CPC ..... *E21B 33/128* (2013.01); *E21B 33/1216* (2013.01)

(58) Field of Classification Search
CPC ..... E21B 33/128; E21B 33/1216; E21B 33/1208; E21B 23/06
See application file for complete search history.

(56) References Cited

U.S. PATENT DOCUMENTS 3,288,222 A * 11/1966 Urbanosky ..... E21B 33/1208 166/134
3,554,280 A * 1/1971 Tucker ..... E21B 33/1208 166/134
3,776,561 A * 12/1973 Haney ..... E21B 33/1208 277/340
8,167,033 B2 * 5/2012 White ..... E21B 33/128 166/134
2006/0260795 A1 * 11/2006 Rescia ..... E21B 33/128 166/51
2007/0044977 A1 * 3/2007 Hendrickson ..... E21B 33/1208 166/387
2007/0199693 A1 * 8/2007 Kunz ..... E21B 33/1277 166/179
2009/0205843 A1 * 8/2009 Gandikota ..... E21B 33/1208 166/387
2010/0072711 A1 * 3/2010 Doane ..... E21B 33/10 277/404
2013/0112398 A1 * 5/2013 White ..... E21B 33/128 166/118
2013/0306331 A1 * 11/2013 Bishop ..... E21B 33/1216 166/387
2014/0116699 A1 * 5/2014 Helms ..... E21B 23/06 166/285
2014/0262209 A1 * 9/2014 Shek ..... E21B 33/10 166/116
2015/0129242 A1 * 5/2015 Farquhar ..... E21B 23/06 166/387

* cited by examiner

*Primary Examiner* — Eugene G Byrd
(74) *Attorney, Agent, or Firm* — Shannon W. Bates; Harper Bates & Champion LLP

(57) ABSTRACT

A buckle prevention ring assembly for use within a conduit, such as casing, having at least one buckle prevention ring may be provided. The buckle prevention ring may be bonded and may provide a fluid and gas tight seal to prevent fluid and gas from leaking out of the casing in a downhole environment.

7 Claims, 9 Drawing Sheets

BUCKLE PREVENTION RING

CROSS REFERENCE TO RELATED APPLICATION

The present application incorporates by reference U.S. Patent Application No. 62/187,558 filed Jul. 1, 2015, entitled "BUCKLE PREVENTION RING," of which is incorporated herein by reference in its entirety.

TECHNICAL FIELD

The disclosure relates generally to downhole equipment. In particular, the disclosure relates to a buckle prevention ring assembly including at least one buckle prevention ring for sealing a packer against a conduit or casing, and a method of forming a buckle prevention ring assembly including at least one buckle prevention ring.

BACKGROUND

Support structures may be used to create seals against fluid flow between portions of the inside diameter of conduit, such as casing, and the outside diameter of a packing element used on a packer. Support structures have been used in oil and gas wells, but they may be used in other types of conduit as well. While it is known to include a support structure in a packer assembly, packers are often unable to remain effective under high pressure due to high compressive loads applied to these support structures. Particularly because these support structures have not been bonded into place, when subjected to intense pressure, the support structures may not remain in place. As such, one side of the packing element buckles in toward the mandrel of the packer and away from the inside of the conduit or casing and causes leakage of fluids and gases.

Generally, a multiple element packer offers more sealing points and provides greater reliability under high pressure. To the contrary, single element packers are known to buckle on one side towards the inside of the packer and away from the inner wall of the conduit or casing when set in a conduit and compressed under high pressures. Consequently, buckling of the packer leads to leaking of fluids and gas, and failure of down-hole equipment.

SUMMARY

Embodiments of the present disclosure generally provide a buckle prevention ring assembly including at least one buckle prevention ring for sealing a conduit, such as a casing, against a packer, and a method of forming a buckle prevention ring assembly including at least one buckle prevention ring bonded into a single packing element to aid in sealing a conduit, such as a casing. It is an object of the present disclosure to provide an apparatus including a buckle prevention ring assembly having a buckle prevention ring to tightly seal the outside diameter of a packer against the inside diameter of a conduit, even under high pressure and compressive loads. It is another object of the present disclosure to provide a method of forming a buckle prevention ring assembly using at least one buckle prevention ring to tightly seal the outside diameter of a packer against the inside diameter of a conduit, even under high pressure and compressive loads.

A buckle prevention ring assembly may include at least one buckle prevention ring arranged around a center portion of a central mandrel. A packing element may surround the center portion of the central mandrel, and an inner diameter of a conduit and an outer diameter of a packer may be sealed using the at least one buckle prevention ring. The conduit and the packer may be fluid-tight and gas-tight. Further, the at least one buckle prevention ring may be arranged to provide an equal amount of packing element material disposed above the at least one buckle prevention ring and below the at least one buckle prevention ring. The packing element may provide an elastomeric seal, and the at least one buckle prevention ring and the packing element may be configured to withstand pressures applied to the buckle prevention ring assembly and may remain in place. The equal amount of the packing element material disposed above the at least one buckle prevention ring and below the at least one buckle prevention ring may fold against one another under high pressures in an engaged state. At least one non-extrusion ring may be arranged to form a seal between the central mandrel and the conduit, and the packing element may not extrude.

A buckle prevention ring assembly may include a packing element that may surround a central mandrel. The assembly may include a plurality of buckle prevention rings that may be bonded and arranged around an interior diameter of the packing element. The plurality of buckle prevention rings may include a first buckle prevention ring that may be bonded and arranged around an interior portion of the packing element which may surround a portion of the central mandrel. The plurality of buckle prevention rings may further include at least one additional buckle prevention ring that may be bonded and arranged around an interior portion of the packing element which may surround a portion of the central mandrel and may anchor a portion of a packer. The plurality of buckle prevention rings may also include an inner diameter of a conduit and an outer diameter of the packer that may be sealed using the plurality of buckle prevention rings. The packing element may have equal dimensions of a packing element material that may be disposed above the first buckle prevention ring and below the first buckle prevention ring. The packer may include seals formed by the first buckle prevention ring and the at least one additional buckle prevention ring. The seals may be arranged to prevent fluid and gas from leaking out of the conduit. The packing element may provide an elastomeric seal. The plurality of buckle prevention rings and the packing element may be configured to withstand pressures that may be applied to the buckle prevention ring assembly and may remain in place. Further, the packing element material disposed above the first buckle prevention ring and below the first buckle prevention ring may fold against one another under high pressures in an engaged state. Additionally, at least one non-extrusion ring may be arranged to form a seal between the central mandrel and a conduit, and the packing element may not not extrude.

A method of forming a buckle prevention ring assembly using a buckle prevention ring may include applying a buckle prevention ring around an interior of a packing element where the packing element may surround a central mandrel. The method may further provide bonding the buckle prevention ring around the packing element and may provide an equal amount of a packing element material above the buckle prevention ring and below the buckle prevention ring. The method may provide bonding a plurality of buckle prevention rings around the packing element which may surround the central mandrel. Additionally, the method may provide applying at least one non-extrusion ring between the central mandrel and the conduit that may prevent the packing element from extruding.

A method of forming a buckle prevention ring assembly using a plurality of buckle prevention rings may provide applying a packing element around a central mandrel. The method may provide bonding the plurality of buckle prevention rings around an interior of the packing element which may surround the central mandrel. The method may also provide sealing an inner diameter of a conduit and an outer diameter of a packer using the plurality of buckle prevention rings. The method may provide applying at least one non-extrusion ring between the central mandrel and the conduit which may prevent the packing element from extruding. The method may provide bonding a first buckle prevention ring around an interior portion of the packing element which may surround a center portion of the central mandrel. Further, the method may provide positioning the first buckle prevention ring around the packing element, and may provide equal dimensions of a packing element material above the first buckle prevention ring and below the first buckle prevention ring. Additionally, the method may provide bonding a second buckle prevention ring around an interior top portion of the packing element which may surround a top portion of the central mandrel and anchor a top end of the packer. The method may provide bonding a third buckle prevention ring around an interior bottom portion of the packing element which may surround a bottom portion of the central mandrel and may anchor a bottom end of the packer. The method may provide forming three seals that may use the first buckle prevention ring, the second buckle prevention ring, and the third buckle prevention ring, respectively. The method may provide arranging the three seals to prevent fluid and gas from leaking out of the conduit. Further, the method may provide forming more than three seals using the plurality of buckle prevention rings.

Other technical features may be readily apparent to one skilled in the art from the following drawings, descriptions and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

The present disclosure generally provides buckle prevention ring assembly 10 for use within conduit 12, such as a casing, having at least one buckle prevention ring 40. Buckle prevention ring 40 may be arranged in packing element 28 to provide fluid and gas tight sealing of buckle prevention ring assembly 10 against conduit 12. It should be appreciated that buckle prevention ring 40 may be referred to using words and phrases including, but not limited to, rigidity ring, dual element converter ring, middle separator ring, middle support ring, middle prevention ring, single element middle ring, single element rigid ring, high pressure expander ring, and single element fold back ring without departing from the present disclosure.

Figure 1:
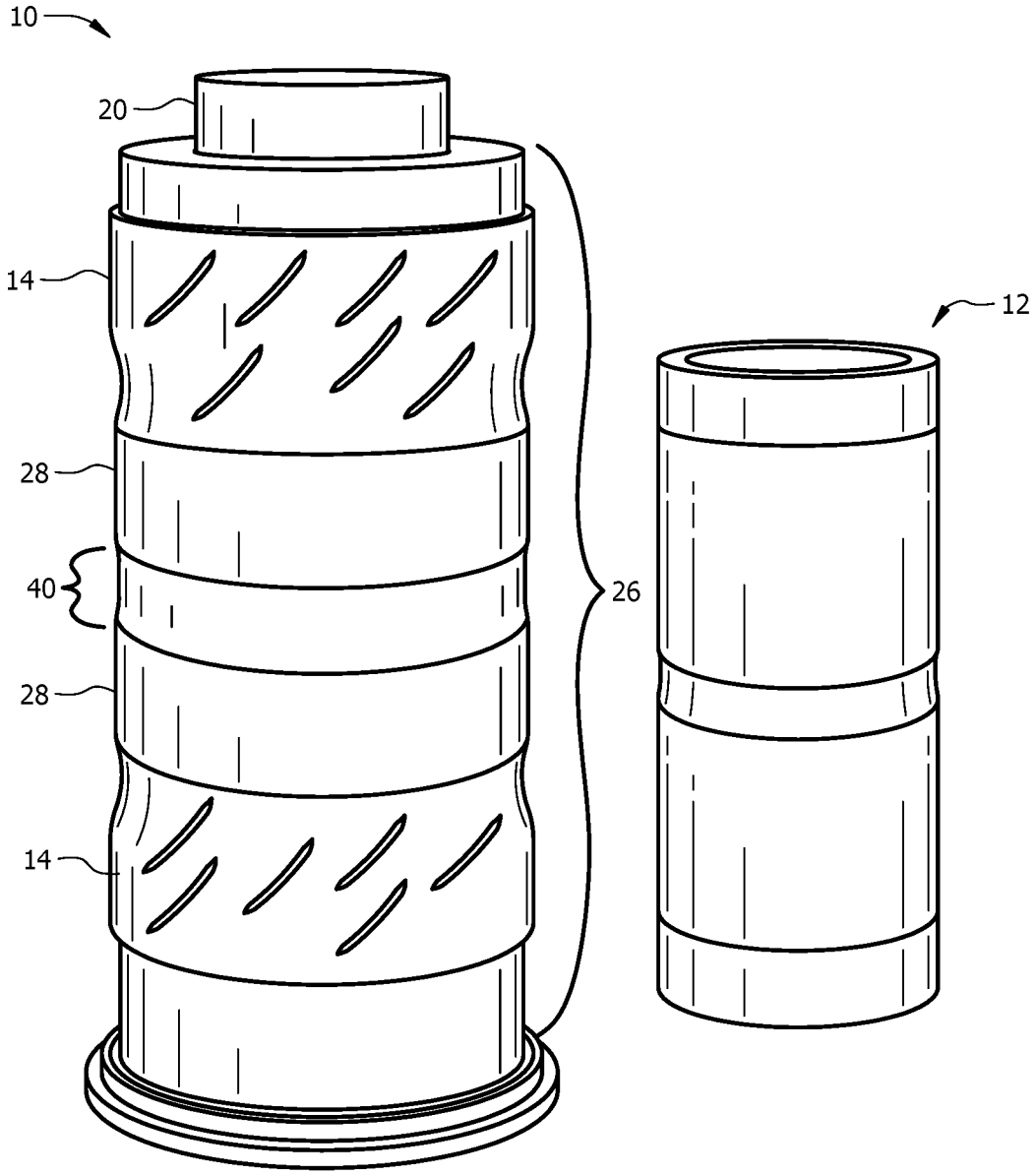
FIG. 1 is a view of a buckle prevention ring assembly in a retracted state according to an embodiment of the present disclosure.

FIG. 1 depicts buckle prevention ring assembly 10 in a retracted state according to an embodiment of the present disclosure. Buckle prevention ring assembly 10 may include central mandrel 20 and slips (not shown) to secure packer 26 with buckle prevention ring assembly 10 within conduit 12. Packer 26 may include at least one packing element 28, at least one buckle prevention ring 40, and at least one non-extrusion ring 14. At least one element 28 may be an elastomeric seal with a recess in each end sized to accommodate non-extrusion ring 14 while buckle prevention ring assembly 10 is in a retracted state. Buckle prevention ring 40 may be arranged and bonded about the center of packing element 28 in the center of packer 26 and may surround a section of the interior diameter of at least one packing element 28, which may surround central mandrel 20. It should be appreciated that a center portion of central mandrel 20 may surround a center of packer 26. It should be appreciated that the center portion of central mandrel 20 may be completely surrounded by packing element 28 and/or by at least one buckle prevention ring 40 without departing from the present disclosure. As shown in FIG. 1, by arranging and bonding buckle prevention ring 40 within the center of packing element 28 on packer 26, buckle prevention ring assembly 10 may perform as if it were a dual element packer. Inclusion of buckle prevention ring 40 or a plurality of buckle prevention rings may ensure that the outer diameter of buckle prevention ring assembly 10 is sealed against the inner diameter of conduit 12. It should be appreciated that a single buckle prevention ring may be bonded and may create a single packing element seal. It should further be appreciated that a single buckle prevention ring may provide a seal that may be as effective as a plurality of buckle prevention rings bonded on a packing element. It should also be appreciated that a single buckle prevention ring may provide an advantage of reduced manufacturing costs, as opposed to a plurality of buckle prevention rings. It should be appreciated that regardless of the components included in buckle prevention ring assembly 10, particularly non-extrusion rings 14 or end components that may secure buckle prevention ring 40 in place, buckle prevention ring 40 and packing element 28 may maintain the same configuration. As such, the portion of buckle prevention ring assembly 10 including bonded buckle prevention ring 40 and packing element 28 may be used with any end components or downhole well equipment. It should also be appreciated that a non-bonded buckle prevention ring may be unsuccessful in withstanding pressures applied to the buckle prevention ring assembly, whether a single buckle prevention ring or a plurality of buckle prevention rings are incorporated into the assembly thereof. It should be appreciated that a height of buckle prevention 40 may be any length without departing from the present disclosure. It should also be appreciated that a length of buckle prevention ring 40 may be any length without departing from the present disclosure. It should further be appreciated that when buckle prevention ring 40 is arranged about packing element 28, opposite ends of buckle prevention ring 40 may be angled or chamfered, and each end of buckle prevention ring 40 may be sloped at approximately 27 degrees with respect to a horizontal axis of a top of buckle prevention ring 40 without departing from the present disclosure.

In another non-limiting exemplary embodiment of the present disclosure, a plurality of buckle prevention rings may be arranged along packer 26 and surround an interior of at least one packing element 28, which may surround central mandrel 20. For example, in addition to buckle prevention ring 40 arranged in the center of packer 26, buckle prevention rings may be arranged near the top of packer 26 and near the bottom of packer 26, so as to anchor each end of packer 26.

Figure 2:
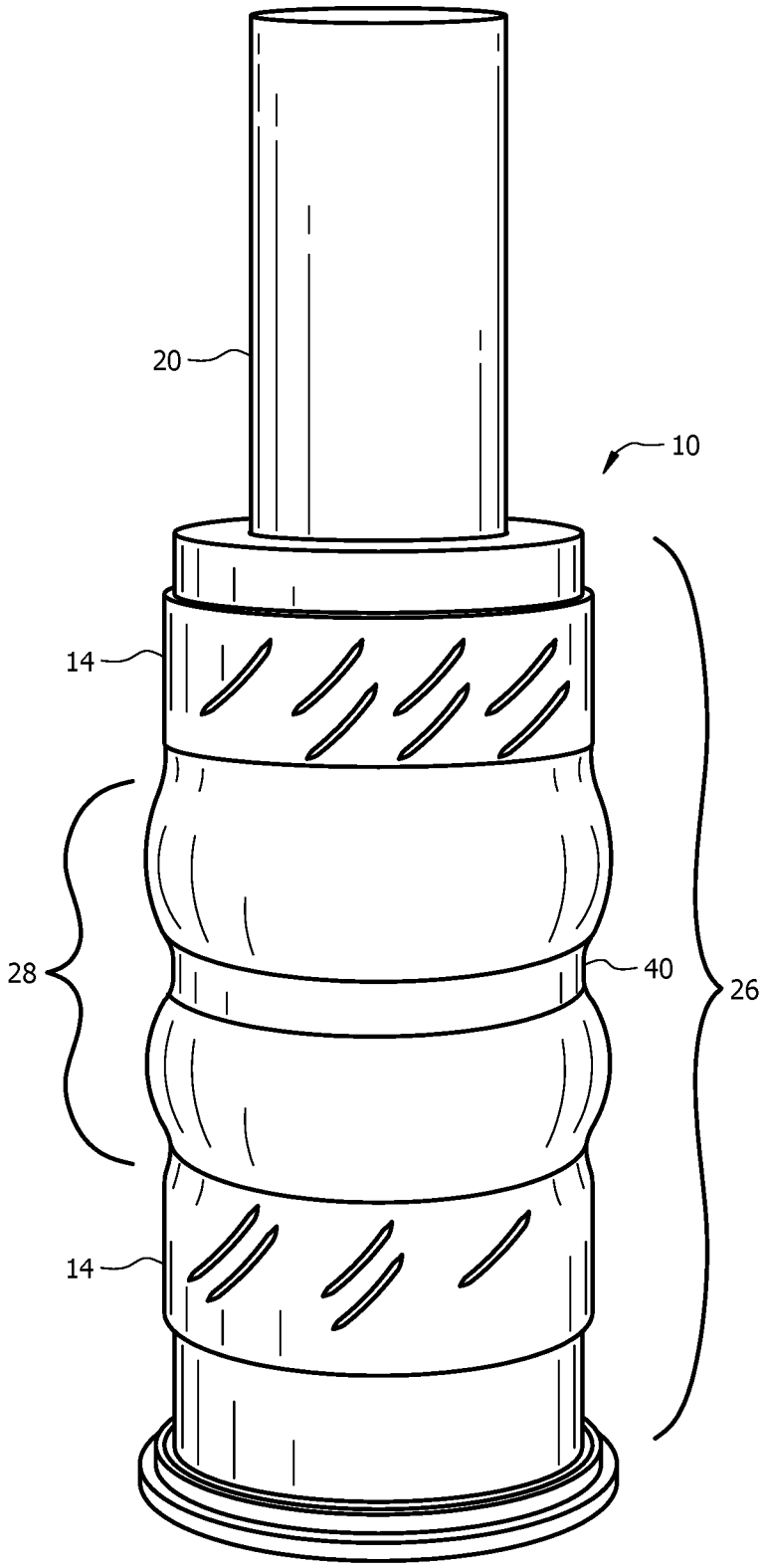
FIG. 2 is a view of a set buckle prevention ring assembly in a partially engaged state according to an embodiment of the present disclosure.

FIG. 2 depicts buckle prevention ring assembly 10 and buckle prevention ring 40 in a partially engaged state according to an embodiment of the present disclosure. As shown in FIG. 2, the middle of packer 26 may include at least one packing element 28. A recess (not shown) may extend around the interior of each packing element 28 creating a shoulder (not shown) on each end of packing element 28. It should be appreciated that buckle prevention ring assembly 10 may surround central mandrel 20 at any location about central mandrel 20 without departing from the present disclosure. According to FIG. 2, buckle prevention ring assembly 10 is in a partially engaged state and under some pressure, and the amount of the packing element material disposed above and below the buckle prevention ring may equally engage. The dual element packer created by buckle prevention ring 40 not only may prevent buckling towards the inside of packer 26 but may help it to remain stable under high pressure. Inclusion of buckle prevention ring 40 may provide a packer that is more rigid prior to being set, and may provide safer and more reliable conveyance downhole, even at high speeds. Non-extrusion rings 14 or end components may further secure buckle prevention ring 40 in place.

Figure 3:
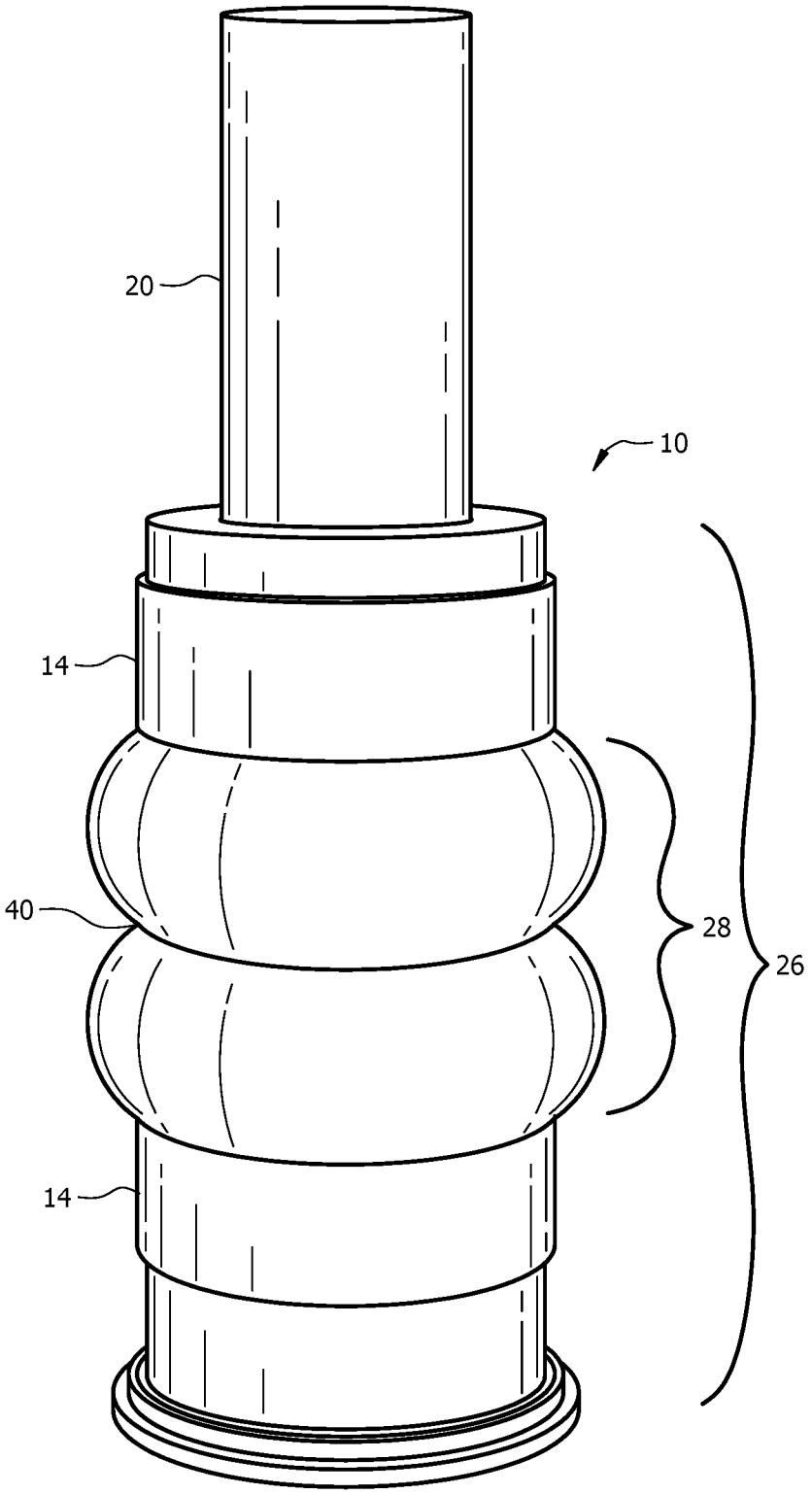
FIG. 3 is a view of a buckle prevention ring assembly in an advanced engaged state according to an embodiment of the present disclosure.

FIG. 3 is a view of set buckle prevention ring assembly 10 and buckle prevention ring 40 in an advanced engaged state according to an embodiment of the present disclosure. As shown in FIG. 3, the amount of packing element material disposed above and below buckle prevention ring 40 may still be equally engaged even under high pressure. By arranging buckle prevention ring 40 in the center of packer 26, material of packing element 28 may fold against itself by portions disposed above and below buckle prevention ring 40 touching at a point near buckle prevention ring 40. Additionally, by arranging buckle prevention ring 40 in the center of packer 26 in composite plugs (not shown), buckle prevention ring assembly 10 may be drilled up and out of a downhole environment at a faster rate. However, it should be appreciated that buckle prevention ring 40 may be arranged in other areas of packer 26 without departing from the present disclosure. It should be appreciated that buckle prevention ring assembly 10 may surround central mandrel 20 at any location about central mandrel 20 without departing from the present disclosure. It should further be appreciated that non-extrusion rings 14 or end components may surround central mandrel 20 above and/or below packing element 28. It should also be appreciated that non-extrusion rings 14 may secure buckle prevention ring 40 in the center of packer 26 or at any location of packer 26 without departing from the present disclosure.

In an embodiment of the present disclosure, if buckle prevention ring assembly 10 is used on a composite plug and is set in a well, a drill bit may contact components of buckle prevention assembly 10 in following order: a first non-extrusion ring, rubber material, buckle prevention ring 40, more rubber material, and a second non-extrusion. Composite materials that form segments (not shown) and support ring (not shown) of non-extrusion ring 14, along with buckle prevention ring 40, may act as an abrasive material and may aid in drilling up rubber in packer 26. Further, the composite materials along with buckle prevention ring 40 may provide for drilling through composite plugs at a faster rate, particularly insofar as buckle prevention ring 40 is bonded.

Figure 4A:
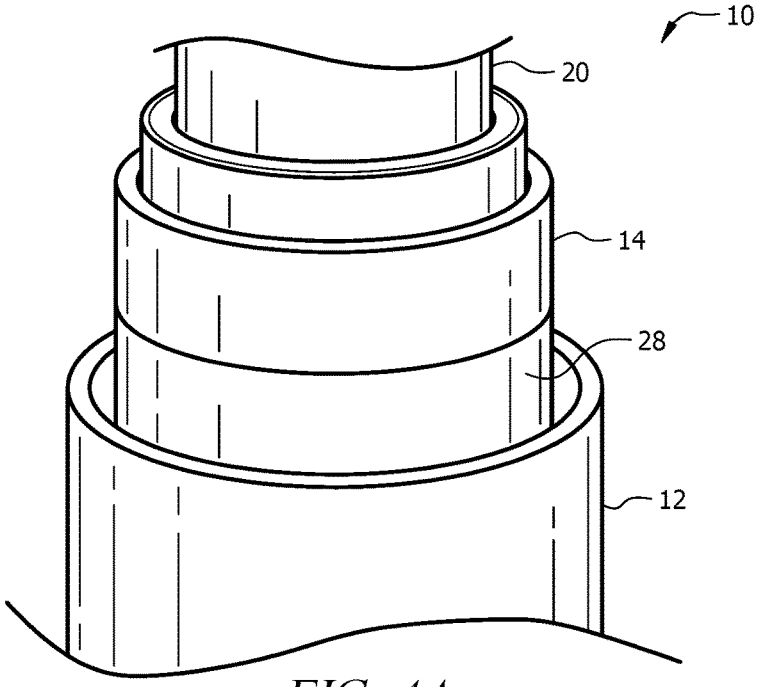
FIG. 4A is a view of a buckle prevention ring assembly inside of a conduit according to an embodiment of the present disclosure.

FIG. 4A shows a view of buckle prevention ring assembly 10 and buckle prevention ring 40 (FIGS. 1-3 and 5A-6C) placed inside of conduit 12 according to an embodiment of the present disclosure. It should be appreciated that conduit 12 may be a casing without departing from the present disclosure. When the top end of packer 26 (FIGS. 1-3 and 6A-6C) is set in an engaged state, including non-extrusion ring 14, non-extrusion ring 14 may be pushed outward to engage conduit 12. Buckle prevention ring 40 (FIGS. 1-3 and 5A-6C) may be arranged and bonded about packing element 28, which may surround central mandrel 20.

Figure 4B:
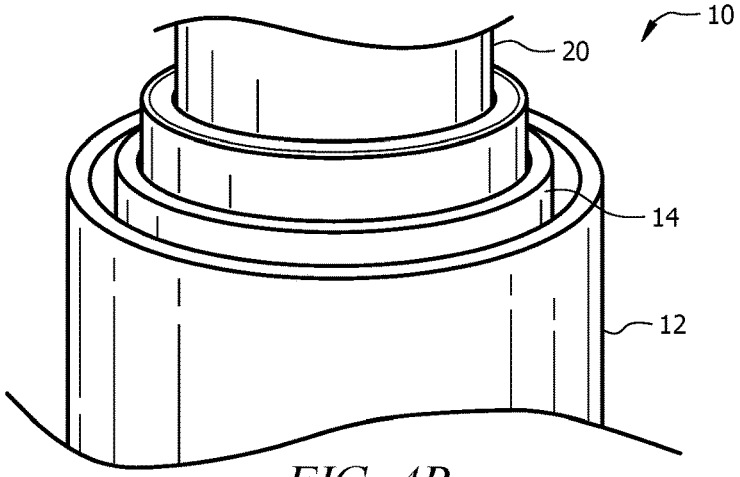
FIG. 4B is a view of a buckle prevention ring assembly inside of a conduit according to an embodiment of the present disclosure.

FIG. 4B shows a view of buckle prevention ring assembly 10 and buckle prevention ring 40 (FIGS. 1-3 and 5A-6C) being set inside of conduit 12 according to an embodiment of the present disclosure. It should be appreciated that conduit 12 may be a casing without departing from the present disclosure. Packer 26 (FIGS. 1-3 and 6A-6C), due to the pressure applied to buckle prevention ring assembly 10, may include an expanding packing element 28 and may move outward towards conduit 12. Under this pressure, non-extrusion ring 14 may form a seal between mandrel 20 and conduit 12 to contain packing element 28 (FIGS. 1-4A and 5A-6C) and prevent packing element 28 from extruding between the forcing cones (not shown) and conduit 12. Additionally, buckle prevention ring 40 may provide a tighter seal between the outside diameter of buckle prevention ring assembly 10 and the inside diameter of conduit 12.

Figure 4C:
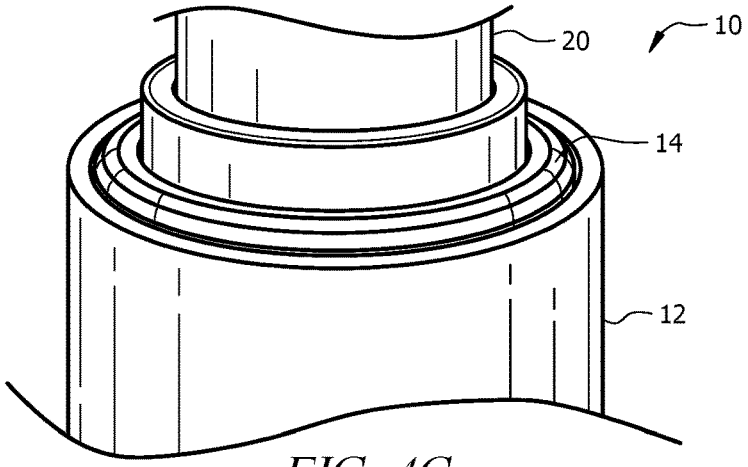
FIG. 4C is a view of a buckle prevention ring assembly inside of a conduit according to an embodiment of the present disclosure.

FIG. 4C shows a view of buckle prevention ring assembly 10 and buckle prevention ring 40 (FIGS. 1-3 and 5A-6C) set inside of conduit 12, according to FIGS. 4A and 4B, in an engaged state, where forcing cones (not shown) may axially move along mandrel 20 towards each other according to one embodiment of the present disclosure. It should be appreciated that conduit 12 may be a casing without departing from the present disclosure. The inclined planes of the forcing cones (not shown) may push non-extrusion ring 14 out to conduit 12 and the pressure on packing element 28 (FIGS. 1-4A and 5A-6C) may be squeezed out to conduit 12 as well. Under this pressure, non-extrusion ring 14 may form a seal between mandrel 20 and conduit 12 to contain packing element 28 (FIGS. 1-4A and 5A-6C) from extruding between forcing cones and conduit 12. Additionally, buckle prevention ring 40 (FIGS. 1-3 and 5A-6C) may provide a tighter seal between the outside diameter of buckle prevention ring assembly 10 and the inside diameter of conduit 12.

Figure 5A:
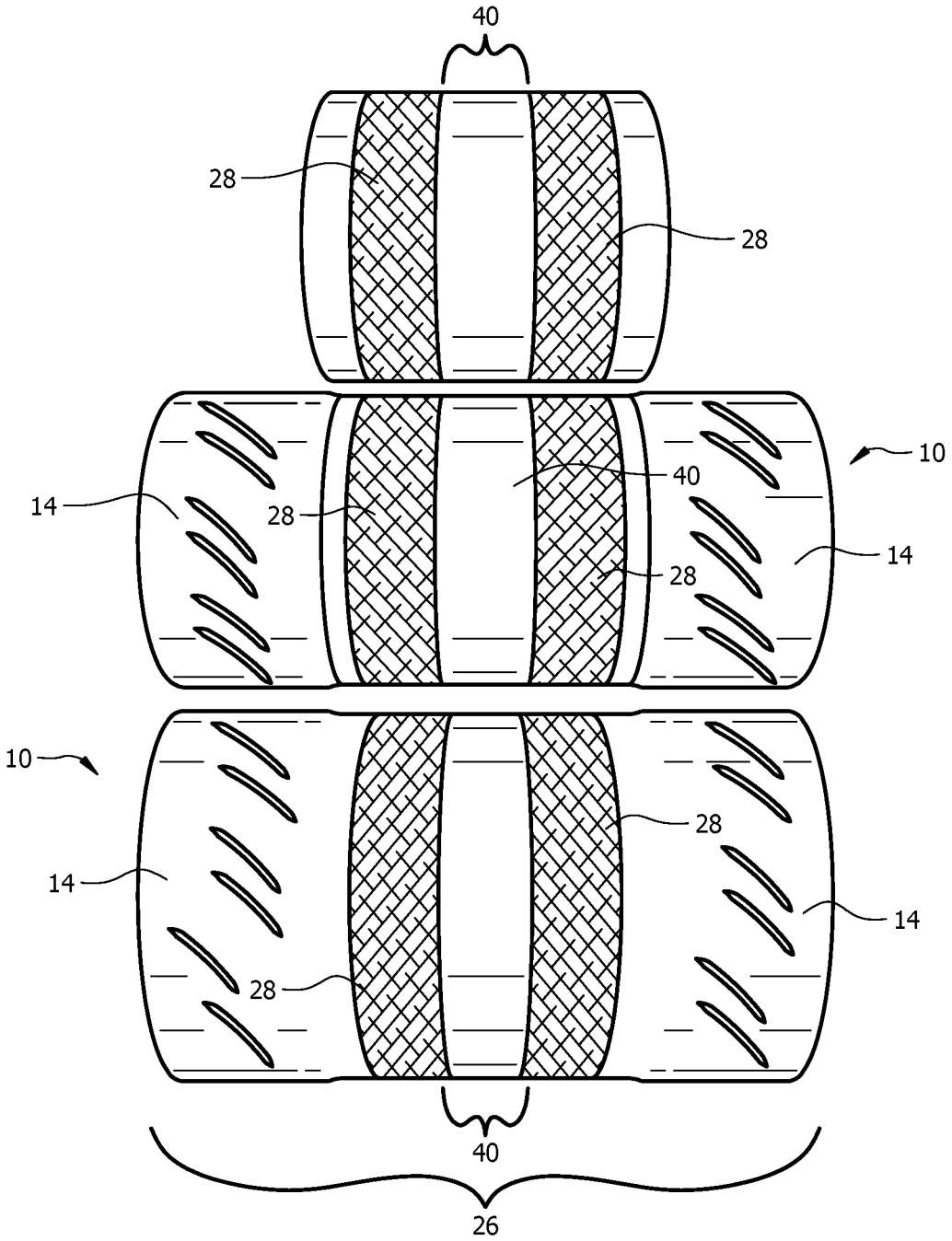
FIG. 5A is a view of buckle prevention ring assembly according to an embodiment of the present disclosure.

FIG. 5A shows a view of the buckle prevention ring assembly according to an embodiment of the present disclosure.

Figure 5B:
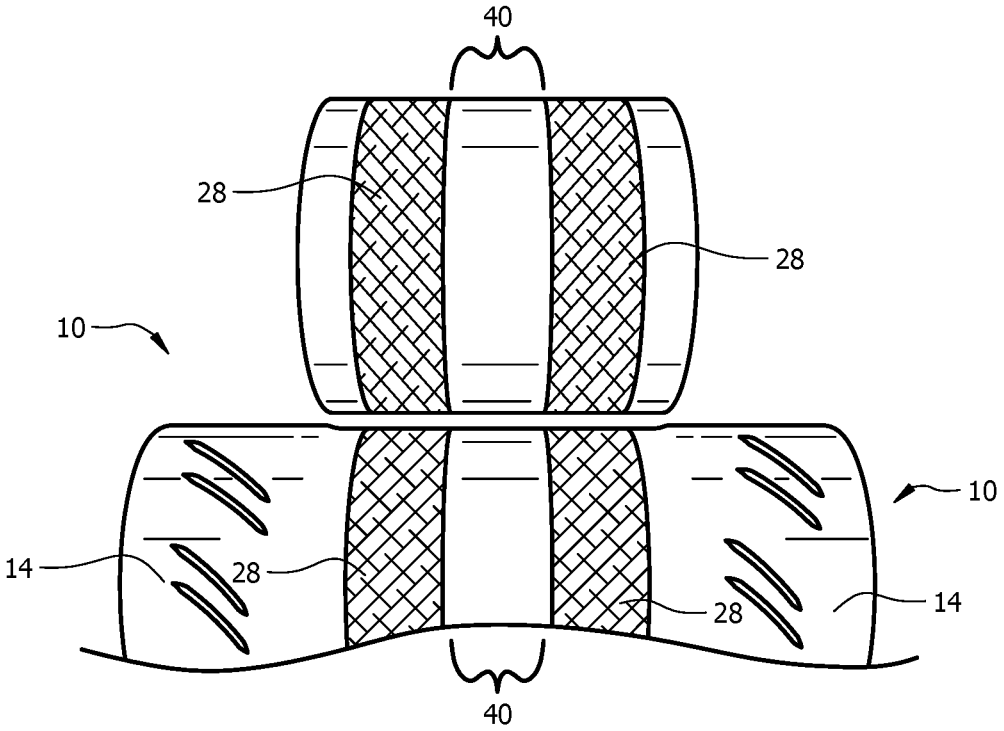
FIG. 5B is a close-up view of a single packing element with a buckle prevention ring bonded in the center portion of the packing element according to an embodiment of the present disclosure.

FIG. 5B shows a close-up view of buckle prevention ring 40 bonded in packing element 28 shown in FIG. 5A according to an embodiment of the present disclosure.

Figure 5C:
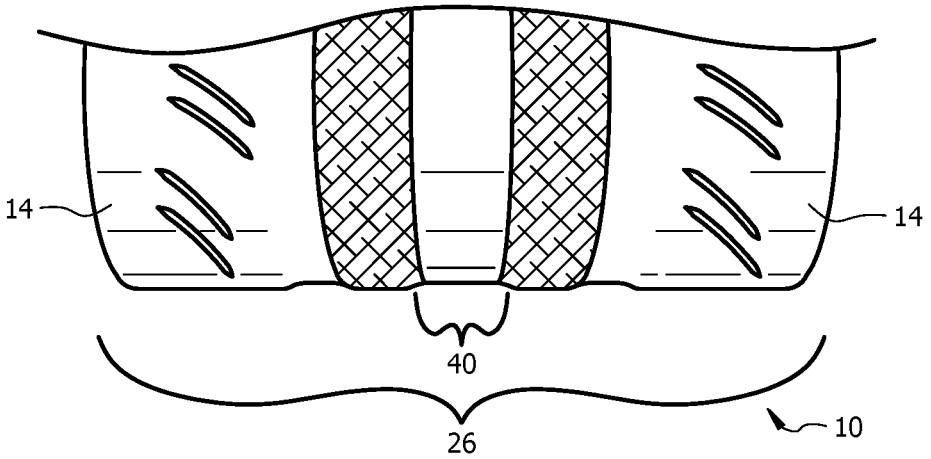
FIG. 5C is a closer-up view of buckle prevention ring assembly according to an embodiment of the present disclosure.

FIG. 5C shows a close-up view of the buckle prevention ring assembly shown in FIG. 5A according to an embodiment of the present disclosure.

Figure 6A:
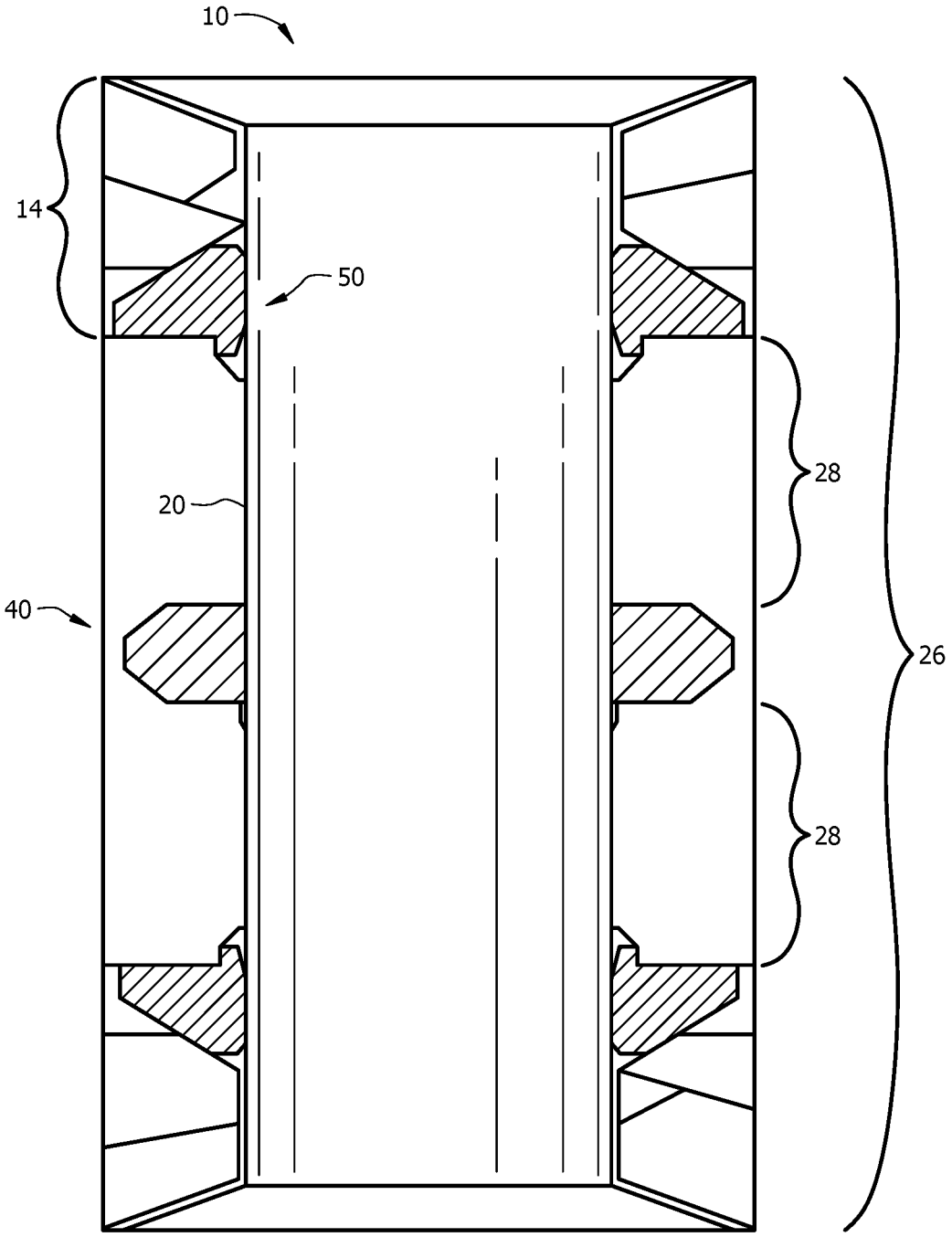
FIG. 6A is a sectional view of a buckle prevention ring assembly according to an embodiment of the present disclosure.

FIG. 6A shows a sectional view of buckle prevention ring assembly 10. Member 50 may fill a void created by expanded rigid segments (not shown) inside of non-extrusion rings 14. Member 50 may form approximately a 30-degree angle with respect to a horizontal axis of at least one packing element 28 and/or a horizontal axis of non-extrusion ring 14. Buckle prevention ring 40 may be arranged and bonded about the center of packing element 28 in the center of packer 26. It should be appreciated that a diameter of mandrel 20 may be any diameter without departing from the present disclosure. It should further be appreciated that a diameter of buckle ring prevention assembly 10 may be any diameter without departing from the present disclosure. It should also be appreciated that a height of packer 26 may be any length without departing from the present disclosure. It should further be appreciated that a height of packing element 28 may be any length without departing from the present disclosure.

Figure 6B:
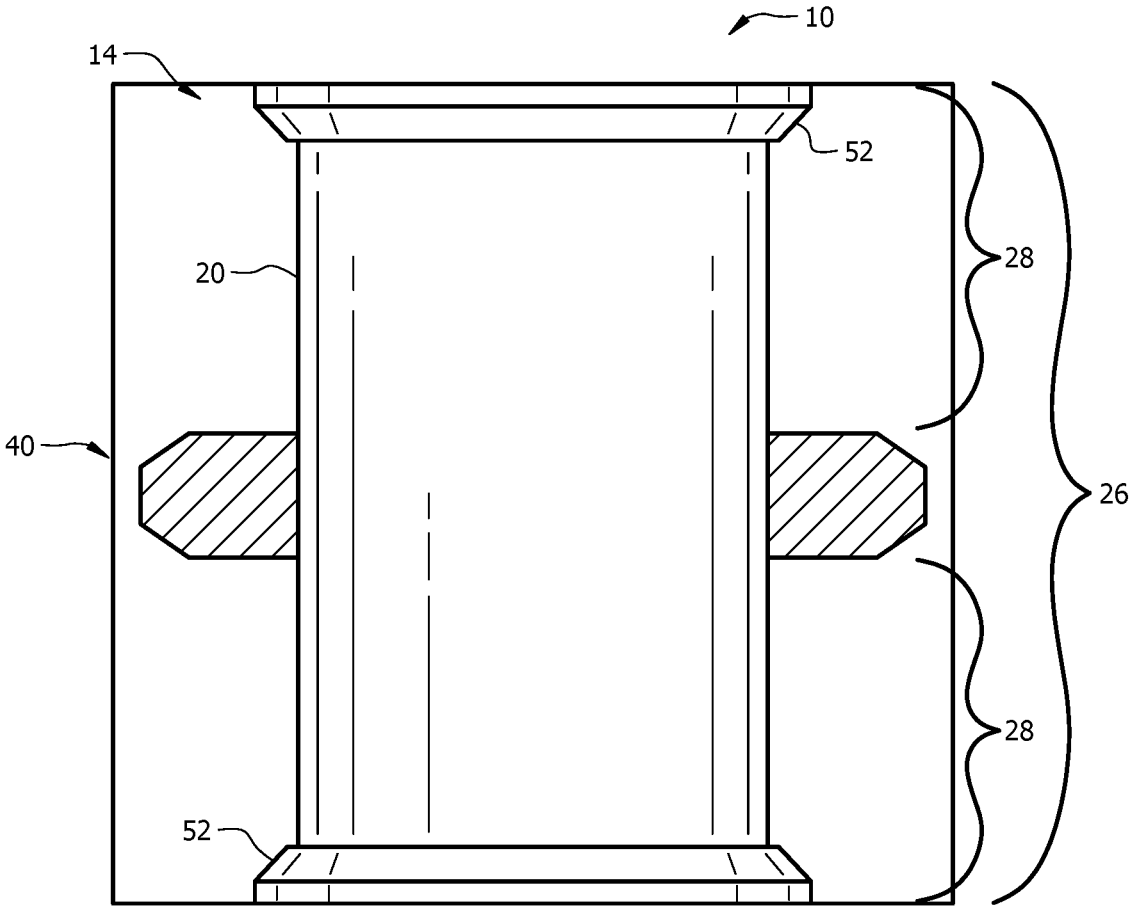
FIG. 6B is a sectional view of a single packing element with one buckle prevention ring bonded in the center portion of the packing element according to an embodiment of the present disclosure.

FIG. 6B shows a sectional view of buckle prevention ring assembly 10 as the assembly is placed and bonded into packing element 28. When buckle prevention ring assembly 10 undergoes pressure and sets, the top of non-extrusion ring 14 may expand outside of a conduit outer diameter. Molded area 52 may accept a protrusion arranged on the base of non-extrusion ring 14. It should be appreciated that a base of molded area 52 may be sloped or angled and may form approximately a 45-degree angle with respect to a vertical axis of mandrel 20. When buckle prevention ring assembly 10 sets, buckle prevention ring 40 may form an angle to the horizontal, as shown in FIG. 6B. Further, when packing elements 28 are subjected to pressure and set, as shown in FIG. 6B, hard segments (not shown) within non-extrusion rings 14 may form an angle to the horizontal axis. It should be appreciated that a single buckle prevention ring or a plurality of buckle prevention rings may be placed on a pin or mandrel 20 of a mold. It should further be appreciated that a single buckle prevention ring or a plurality of buckle prevention rings may be held in place on a pin or mandrel 20 of a mold and rubber may be injected around the single buckle prevention ring or the plurality of buckle prevention rings. It should also be appreciated that molding a single buckle prevention ring may set and provide a seal that may as effective as molding a plurality of buckle prevention rings on mandrel 20 of a packer.

Figure 6C:
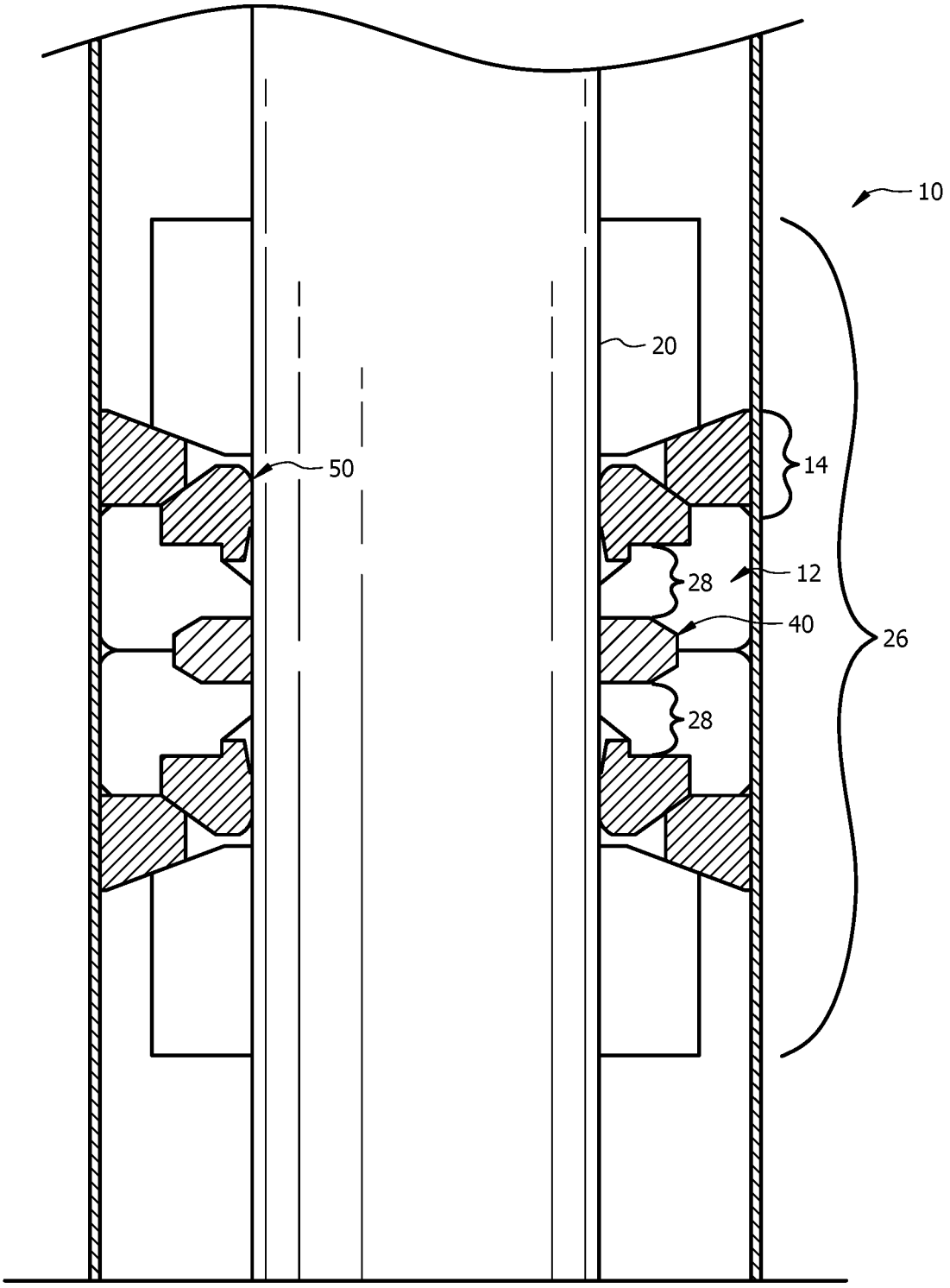
FIG. 6C is a sectional view of a buckle prevention ring assembly inside of a conduit according to an embodiment of the present disclosure.

FIG. 6C shows a sectional view of buckle prevention ring assembly 10 and buckle prevention ring 40 set inside of conduit 12 according to an embodiment of the present disclosure. Member 50 may fill a void created by expanded rigid segments (not shown) inside of non-extrusion rings 14. Buckle prevention ring 40 may be arranged and bonded about the center of packing element 28 in the center of packer 26. It should be appreciated that conduit 12 may be a casing without departing from the present disclosure. It should be appreciated that buckle prevention ring 40 may be any diameter without departing from the present disclosure. It should further be appreciated that mandrel 20 may be approximately 2750 inches or 6985 centimeters in diameter. It should also be appreciated that conduit 12 may be any diameter without departing from the present disclosure.

According to a non-limiting exemplary embodiment of buckle prevention ring assembly 10, a plurality of buckle prevention rings 40 may be located at a plurality of locations along packer 26. The selection of the number of buckle prevention rings 40 depends, at least, on the anticipated degree of pressure applied to the packer in a downhole environment. It should be appreciated that an embodiment of the present disclosure may dramatically improve the uniformity of buckle prevention ring assembly 10 under various pressures, particularly at pressures over 2,000 pounds per square inch (PSI), and with various buckle prevention ring assembly dimensions. It should also be appreciated that embodiments of the present disclosure may hold up to 10,000 PSI without causing buckle prevention ring assembly 10 to experience any deformities or buckling. It should be appreciated that embodiments of the present disclosure may hold up to 7,500 PSI without causing buckle prevention ring assembly 10 to experience any deformities or buckling. It should also be appreciated that embodiments of the present disclosure may hold up to pressures less than 7,500 PSI and/or above 10,000 PSI without causing buckle prevention ring assembly 10 to experience any deformities or buckling. Further, it should be appreciated that buckle prevention ring 40 may improve the placement center of buckle prevention ring assembly 10 inside of a conduit, casing, and/or downhole well environment.

Buckle prevention ring 40 may be made of multiple materials depending on the desired properties. Some examples may include, but are not limited to, composite materials, metals, such as steel, copper, bronze, aluminum, brass, cast iron, composite bronze, or ductile metal, or rigid plastics, such as phenolic thermal resins and similar rigid plastics. Likewise, elastomeric matrix may be made from a variety of elastomers such as vulcanized rubber, either natural or synthetic, of varying hardnesses or durometers. The selection of materials for non-extrusion ring 14 may depend on the rigidity needed, the anticipated corrosiveness of the setting, the bonding between the elastomeric matrix and hard segments, and the speed with which non-extrusion ring 14 is expected to engage conduit 12. All of these factors may balance when selecting materials for the hard segments and elastomeric matrix of non-extrusion ring 14. If appropriate, aluminum may be favored for hard segments because of it relatively high strength and ease of drillability after use.

It may be advantageous to set forth definitions of certain words and phrases used in this patent document. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An assembly, comprising:

a central mandrel;

a packer with a single packing element having an inner diameter and an outer diameter, the inner diameter surrounding the central mandrel;

the single packing element comprising an elastomeric packing element material with a buckle prevention ring at least partially embedded therein;

the buckle prevention ring bonded to the elastomeric packing element material during manufacture of the packing element via an injection molding process;

the buckle prevention ring surrounding the central mandrel; and the buckle prevention ring arranged to provide a substantially equal amount of the packing element material disposed above the buckle prevention ring and below the buckle prevention ring;

wherein when the packer is in an engaged state against a conduit within which the assembly is disposed, the single packing element provides a first elastomeric seal against the conduit at a first position above the buckle prevention ring and a second elastomeric seal at a second position below the buckle prevention ring; and wherein the equal amount of the packing element material disposed above the buckle prevention ring and below the buckle prevention ring fold against one another on the outer diameter of the single packing element and along a mid-line of the buckle prevention ring to engage the conduit and thereby provide the first elastomeric seal and the second elastomeric seal, respectively, when the packer is in the engaged state against the conduit within which the assembly is disposed.

2. The assembly of claim 1, further comprising:

at least one non-extrusion ring arranged to form a seal between the central mandrel and the conduit when the packer is the engaged state, wherein the packing element does not extrude.

3. An assembly, comprising:

a packer with a single packing element having an inner diameter and an outer diameter, the inner diameter surrounding a central mandrel;

the single packing element comprising an elastomeric packing material with a plurality of buckle prevention rings each encapsulated at least partially therein and bonded to the elastomeric packing material during manufacture of the packing element via an injection molding process, the plurality of buckle prevention rings comprising:

a first buckle prevention ring surrounding the central mandrel and positioned substantially centrally along a length of the packing element; and at least one additional buckle prevention ring surrounding a portion of the central mandrel, thereby anchoring a portion of the assembly; and the packing element having substantially equal dimensions of the packing element material disposed above the first buckle prevention ring and below the first buckle prevention ring;

wherein when the packer is in an engaged state against a conduit within which the assembly is disposed, the single packing element provides a first elastomeric seal against the conduit at a first position above the first buckle prevention ring and a second elastomeric seal at a second position below the first buckle prevention ring; and wherein the packing element material disposed above the first buckle prevention ring and below the first buckle prevention ring fold against one another on the outer diameter of the single packing element and along a mid-line of the buckle prevention ring to engage the conduit and thereby provide the first elastomeric seal and the second elastomeric seal, respectively, when the packer is in the engaged state against the conduit within which the assembly is disposed.

4. The assembly of claim 3, further comprising:

at least one non-extrusion ring arranged to form a seal between the central mandrel and the conduit when the packer is the engaged state, wherein the packing element does not extrude.

5. The assembly of claim 4, wherein the buckle prevention ring is configured to inhibit the packing element from buckling inward toward the central mandrel when the assembly is under applied pressure.

6. The assembly of claim 1, wherein the packer is configured to withstand applied pressures such that the buckle prevention ring remains in place with respect to the central mandrel when the packer is in the engaged state against the conduit within which the assembly is disposed.

7. The assembly of claim 3, wherein the packing element is configured to withstand applied pressures such that the plurality of buckle prevention rings remain in place with respect to the central mandrel when the packer is in the engaged state against the conduit within which the assembly is disposed.

* * * * *